US007495628B2

(12) United States Patent
Fujita

(10) Patent No.: US 7,495,628 B2
(45) Date of Patent: Feb. 24, 2009

(54) CORNER REFLECTOR ANTENNA WITH GROUND PLATE

(75) Inventor: Mutsuo Fujita, Kitamoto (JP)

(73) Assignee: Hitachi Kokusai Electric Inc., Tokyo (JP)

( * ) Notice: Subject to any disclaimer, the term of this patent is extended or adjusted under 35 U.S.C. 154(b) by 147 days.

(21) Appl. No.: 11/705,751

(22) Filed: Feb. 14, 2007

(65) Prior Publication Data

US 2007/0188400 A1 Aug. 16, 2007

(30) Foreign Application Priority Data

Feb. 14, 2006 (JP) ..... 2006-036700
Oct. 31, 2006 (JP) ..... 2006-297097

(51) Int. Cl.
*H01Q 13/10* (2006.01)
*H01Q 19/10* (2006.01)

(52) U.S. Cl. ..... 343/834; 343/767; 343/841

(58) Field of Classification Search ..... 343/700 MS, 343/767, 770, 833, 834, 821, 841, 912
See application file for complete search history.

(56) References Cited

U.S. PATENT DOCUMENTS 3,219,954 A * 11/1965 Rutelli ..... 333/240
3,545,001 A * 12/1970 Giller ..... 343/776
5,151,707 A * 9/1992 Kumpfbeck et al. ..... 343/705
2005/0162333 A1 7/2005 Kaneko et al.

FOREIGN PATENT DOCUMENTS

JP 2005-244926 9/2005

* cited by examiner

*Primary Examiner*—Tan Ho
(74) *Attorney, Agent, or Firm*—Bacon & Thomas, PLLC

(57) ABSTRACT

A corner reflector antenna includes a ground plate having a main surface, a reflector including a rectangular first metal plate and a rectangular second metal plate which are perpendicularly provided on the main surface of the ground plate, the first and second metal plates being combined together to form a prescribed angle, a radiator including a rectangular third metal plate perpendicularly provided on the main surface, at a position where the angle is divided in half, the third metal plate including a first edge which is opposite the main surface, the first edge having a plurality of first cutouts, and a second edge which is opposite the reflector, the second edge having a second cutout extending toward the reflector, and a first feeding point and a second feeding point provided on respective sides of the second cutout on the third metal plate in the vicinity of the second edge.

12 Claims, 8 Drawing Sheets

CORNER REFLECTOR ANTENNA WITH GROUND PLATE

CROSS-REFERENCE TO RELATED APPLICATIONS

This application is based upon and claims the benefit of priority from prior Japanese Patent Applications No. 2006-036700, filed Feb. 14, 2006; and No. 2006-297097, filed Oct. 31, 2006, the entire contents of both of which are incorporated herein by reference.

BACKGROUND OF THE INVENTION

1. Field of the Invention

The present invention relates to a corner reflector antenna with a ground plate having a wideband characteristic.

2. Description of the Related Art

A conventional corner reflector antenna with a ground plate has a ground plate 21, a radiator 22, a corner reflector 23, an insulator 24, and a feeding line 25 as shown in FIG. 11. The ground plate 21 is made of, for example, a rectangular metal conductor having four sides each with a length equal to about 0.6 wavelength with respect to an operating frequency. The radiator 22, insulated by the insulator 24, is perpendicularly installed on the ground plate 21 in the vicinity of its center. The radiator 22 is made of, for example, a bar-like metal conductor with a thickness equal to about 0.015 wavelength and a length equal to about 0.25 wavelength. The radiator 22 is supplied with signals through the feeding line 25. The corner reflector 23 is formed of two rectangular metal plates 23*a* and 23*b* combined together so as to form a prescribed angle. The corner reflector 23 is perpendicularly installed on the ground plate 21 so that the distance between the apical angle (the combined part between the metal plates 23*a* and 23*b*) of the corner reflector 23 and the radiator 22 is equal to about 0.35 wavelength. In this case, the metal plates 23*a* and 23*b* have a width equal to about 0.35 wavelength and a height equal to about 0.45 wavelength and are combined together so as to form an apical angle of 120°.

The corner reflector antenna with the ground plate in FIG. 11 operates as a unidirectional antenna. As shown, in FIGS. 12A and 12B, by vertical directivity and horizontal directivity with respect to the vertical polarization of the corner reflector antenna with the ground plate in FIG. 11, the direction of maximum directivity of vertical directivity coincides with a launch angle of about 27.5° with respect to a horizontal direction. The figures also show that the sensitivity decreases by about 1.5 dB.

Jpn. Pat. Appln. KOKAI Publication No. 2005-244926 discloses a UHF wideband antenna having a generally rectangular dipole element and a corner reflector provided behind the dipole element. The UHF wideband antenna uses a plate-like dipole element or a dipole element having a cavity formed in its center to balance the amplitude of an electric wave radiated from a feeding side with the amplitude of an electric wave radiated from a non-feeding side. This prevents the direction of maximum sensitivity of vertical directivity with respect to the vertical polarization from coinciding with the launch direction.

Further, with the corner reflector antenna with the ground plate in FIG. 11, an attempt to reduce the size of the ground plate 21 further increases the launch angle in the direction of maximum sensitivity, while further reducing the sensitivity in the horizontal direction. This prevents a reduction in the size of the ground plate 21. Moreover, the corner reflector antenna with the ground plate in FIG. 11 has its impedance varying significantly depending on frequency. Thus, it is difficult for the corner reflector antenna with the ground plate in FIG. 11 to offer a wideband characteristic as is apparent from a voltage standing wave ratio (VSWR) characteristic observed at a characteristic impedance of 50Ω shown in FIG. 13. FIG. 13 shows a frequency f/fo on the axis of abscissa and VSWR on the axis of ordinate. fo denotes a central frequency of the operating frequency.

BRIEF SUMMARY OF THE INVENTION

An object of the present invention is to provide a corner reflector antenna with a ground plate which prevents the direction of maximum sensitivity of vertical directivity with respect to the vertical polarization from coinciding with the launch direction to reduce a possible decrease in horizontal sensitivity, while offering the desired directivity characteristic and impedance characteristic over a wide band.

According to a first aspect of the invention, there is provided a corner reflector antenna comprising: a ground plate having a main surface; a reflector including a rectangular first metal plate and a rectangular second metal plate which are perpendicularly provided on the main surface of the ground plate, the first and second metal plates being combined together to form a prescribed angle; a radiator including a rectangular third metal plate perpendicularly provided on the main surface of the ground plate, at a position where the angle is divided in half, the third metal plate including a first edge which is opposite the main surface, the first edge having a plurality of first cutouts, and a second edge which is opposite the reflector, the second edge having a second cutout extending toward the reflector; and a first feeding point and a second feeding point provided on respective sides of the second cutout on the third metal plate in the vicinity of the second edge.

According to a second aspect of the invention, there is provided a corner reflector antenna comprising: a ground plate having a main surface; a corner reflector provided on the main surface of the ground plate and having a reflecting surface; a radiator including a rectangular metal plate perpendicularly provided on the main surface of the ground plate, in front of the reflecting surface, the metal plate including a first edge which is opposite the main surface, the first edge having a plurality of first cutouts, and a second edge which is opposite the corner reflector, the second edge having a second cutout extending toward the corner reflector; a first feeding point and a second feeding point provided on respective sides of the second cutout on the metal plate in the vicinity of the second edge; and an impedance converter connected between the first and second feeding points and a feeding line.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described below with reference to the accompanying drawings.

FIRST EMBODIMENT

Figure 1:
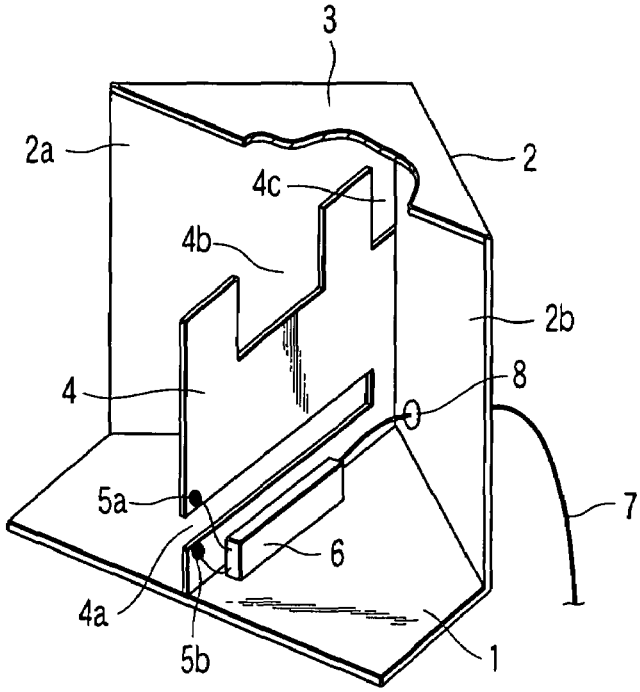
FIG. 1 is a perspective view showing a corner reflector antenna with a ground plate according to a first embodiment of the present invention.

As shown in FIG. 1, a corner reflector antenna with a ground plate according to the present embodiment has a ground plate 1, a corner reflector 2, a shield plate 3, a radiator 4, feeding points 5*a* and 5*b*, an impedance converter 6, and a feeding line 7.

The ground plate 1 is, for example, a pentagonal metal plate. The corner radiator 2 is perpendicularly installed on a top surface of the ground plate 1 at one end and is composed of two rectangular metal plates 2*a* and 2*b* combined together so as to form a prescribed angle with respect to the center of the plate. The radiator 4, composed of a rectangular metal plate having a plurality of cutouts, is perpendicularly provided in the center of top surface of the ground plate 1 at a position where the apical angle of the corner reflector 2 is divided in half. The ground plate 1 is formed almost like a pentagon by cutting a part sticking rearward from the corner reflector 2 provided at one end of a rectangular metal plate having a width set equivalent to or smaller than the opening width of the corner reflector 2. The other end of the ground plate 1 is set substantially flush with the extension of the radiator 4.

The corner reflector 2 is constructed by combining the two rectangular metal plates 2*a* and 2*b* so that the metal plates 2*a* and 2*b* form an apical angle of about 120°; each of the rectangular metal plates has, for example, long sides (height) with a length equal to about 0.45 wavelength and short sides (width) with a length equal to about 0.35 wavelength. The corner reflector 2 has a through-hole through which the feeding line 7 is guided via an insulating member 8. The shield plate 3, composed of a triangular metal plate, is provided at an upper end of the corner reflector 2, that is, the end lying opposite the ground plate 1, and parallel to the ground plate. The shield plate 3 improves the horizontal sensitivity of the corner reflector antenna with the ground plate in FIG. 1. FIG. 1 shows the partly cutaway shield plate 3, provided on the corner reflector 2.

Figure 2:
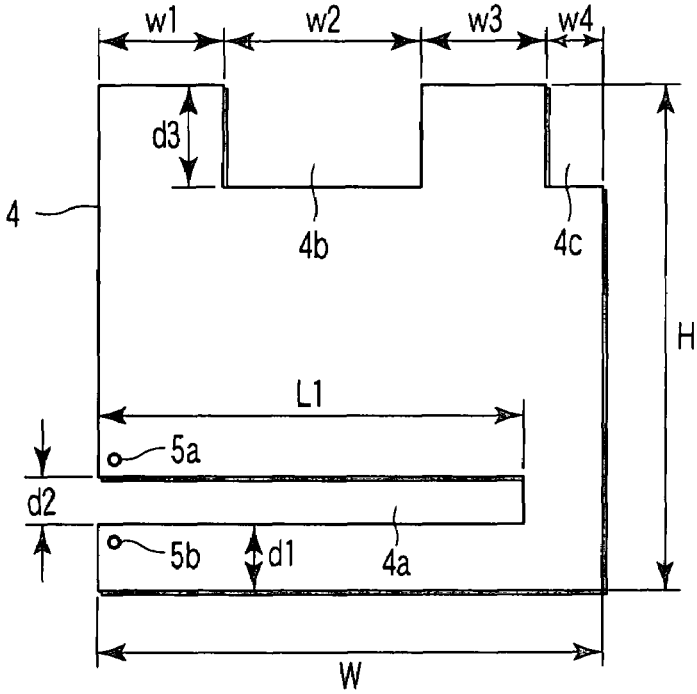
FIG. 2 shows a specific example of a radiator 4 in the corner reflector antenna with the ground plate in FIG. 1.

The radiator 4 is, for example, a metal plate having long sides with a width H equal to about 0.4 wavelength and short sides with a width W equal to about 0.35 wavelength. The short sides correspond to an upper end and a lower end. As shown in FIG. 2, the radiator 4 has a radiating cutout 4*a* formed a prescribed distance d1 (about 0.06 wavelength) away from the lower end and parallel to the short sides and having a width d2 set equal to about 0.05 wavelength and a length L1 set equal to about 0.25 to 0.33 wavelength. The radiator 4 also has adjusting cutouts 4*b* and 4*c* at the upper end. In this case, the distance w1 between a front end of the radiator 4 and the adjusting cutout 4*b* is set equal to about 0.09 wavelength. The width w2 of the adjusting cutout 4*b* is set equal to about 0.14 wavelength. The distance w3 between the adjusting cutouts 4*b* and 4*c* is set equal to about 0.09 wavelength. The width w4 of the adjusting cutout 4*c* is set equal to about 0.03 wavelength. The depth d3 of the adjusting cutouts 4*b* and 4*c* is set equal to about 0.1 wavelength. The adjusting cutouts 4*b* and 4*c* cancel the phases of currents emitted in a zenithal direction to prevent the direction of maximum sensitivity from coinciding with the upward direction.

The feeding points 5*a* and 5*b* are provided at the front end of the radiator 4 so as to sandwich the radiating cutout 4*a* between them. The feeding points 5*a* and 5*b* are connected to the feeding line 7 via an impedance converter 6. The feeding line 7 is led out of the antenna through the through-hole formed in the corner reflector 2, while being insulated by an insulating member 8.

Figure 3A:
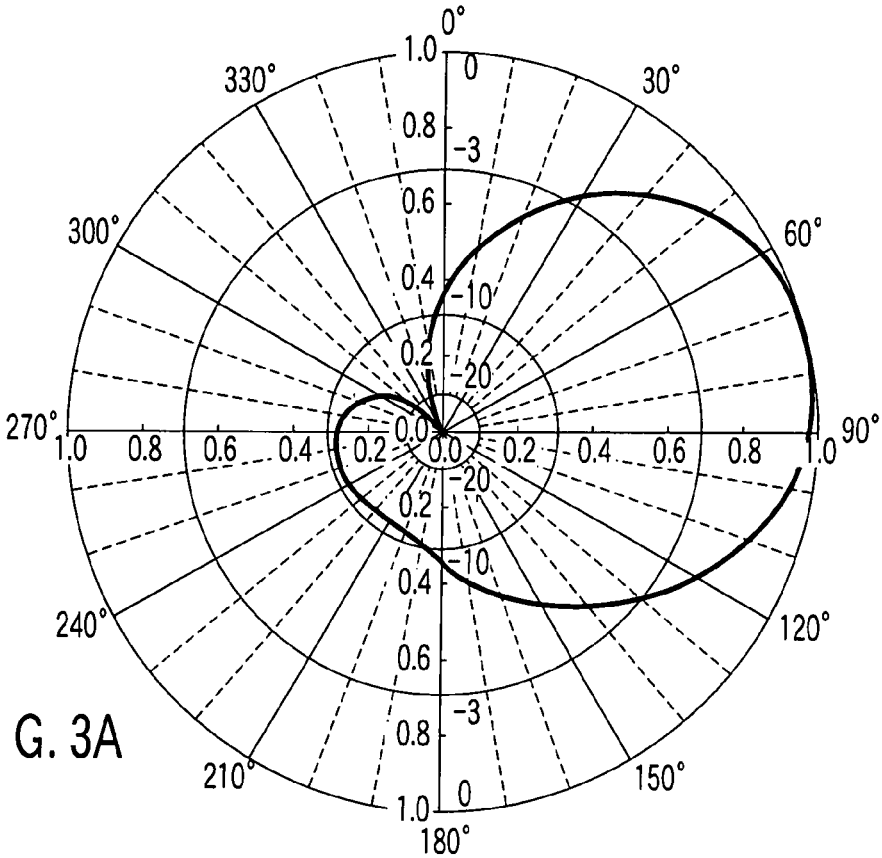
FIG. 3A shows vertical directivity with respect to a vertical polarization at the central frequency of the operating frequency of the corner reflector antenna with the ground plate in FIG. 1.
Figure 3B:
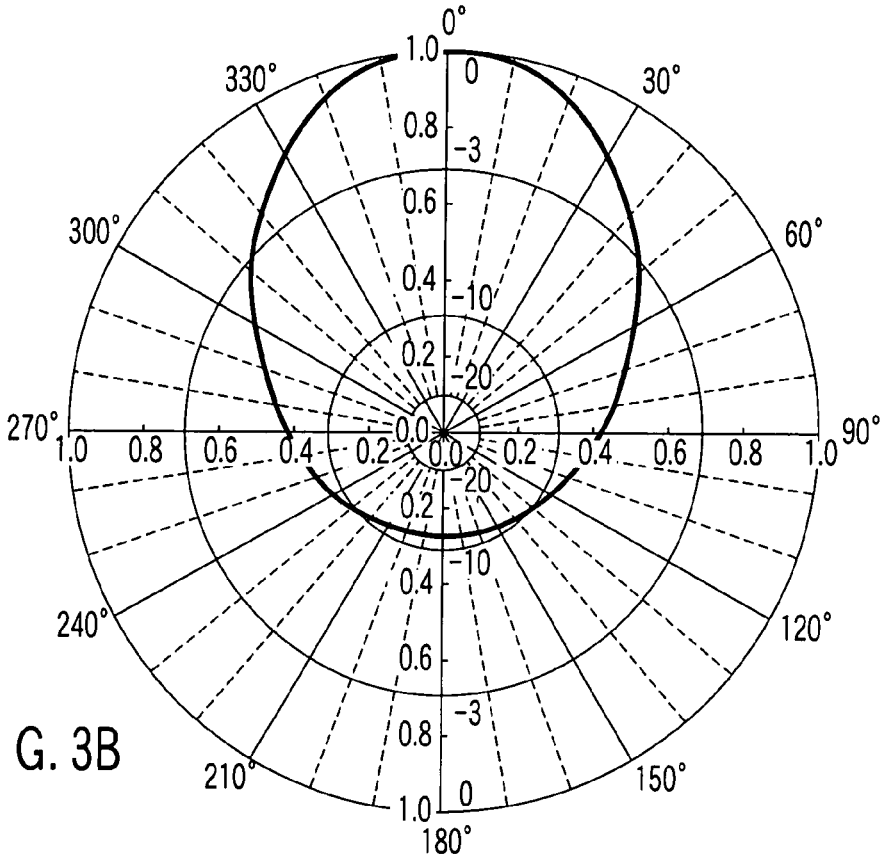
FIG. 3B shows horizontal directivity with respect to the vertical polarization at the central frequency of the operating frequency of the corner reflector antenna with the ground plate in FIG. 1.

As shown in FIGS. 3A and 3B, the corner reflector antenna with the ground plate in FIG. 1 can reduce, at the central frequency of the operating frequency, a launch angle in the direction of maximum sensitivity of vertical directivity with respect to the vertical polarization at the central frequency of the operating frequency, to about 10° as well as a possible decrease in sensitivity in a horizontal direction to about 0.2 dB.

The real part of the impedance seen looking from the feeding points 5*a* and 5*b* can be adjusted on the basis of the distance d1 between the radiating cutout 4*a* and the ground plate 1. That is, increasing the distance d1 between the radiating cutout 4*a* and the ground plate 1 enables an increase in the real part of the impedance. In contrast, reducing the distance d1 enables a reduction in the real part of the impedance. The present embodiment sets the cutout width d2 of the radiating cutout 4*a* equal to about 0.05 wavelength and the distance d1 between the radiating cutout 4*a* and the ground plate 1 equal to about 0.06 wavelength to set the real part of the impedance to about 100Ω to about 300Ω over a wide band. Thus, a possible variation of reactance in response to a possible variation in frequency can be reduced to −80Ω to +120Ω. Consequently, setting a characteristic impedance to 200Ω provides a wideband antenna with a VSWR characteristic of at most 2.

Figure 4:
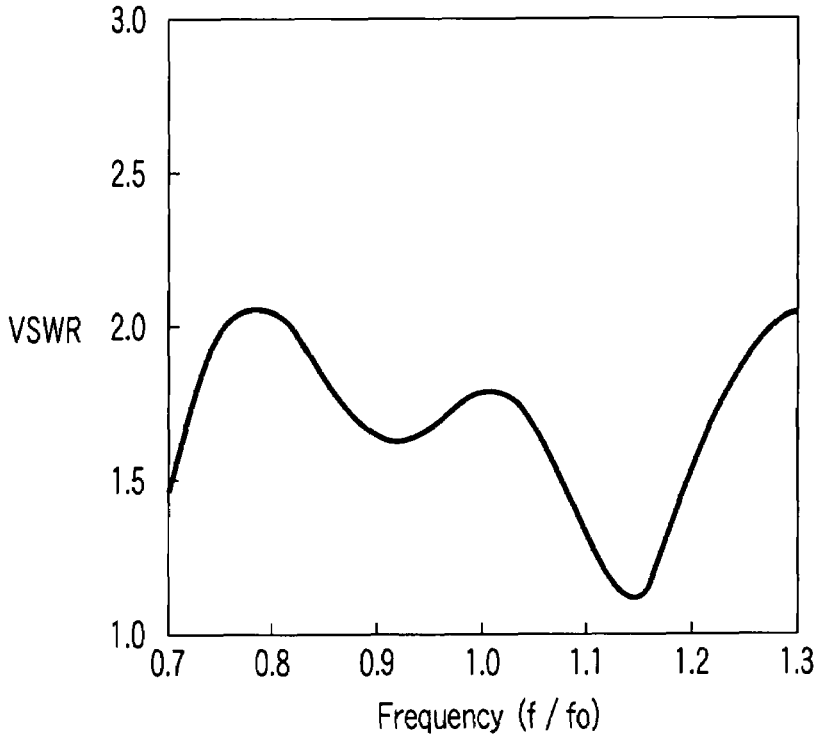
FIG. 4 shows a VSWR characteristic observed after an impedance conversion in the corner reflector antenna with the ground plate in FIG. 1.

An example of the impedance converter 6 converting the impedance from 200Ω to 50Ω is a U-balun. FIG. 4 shows a VSWR characteristic obtained by using a U-balun as the impedance converter 6 connected to the feeding points 5*a* and 5*b* and converting the impedance from 200Ω to 50Ω. In FIG. 4, the axis of abscissa shows a frequency (f/fo). The axis of ordinate shows VSWR.

The present embodiment can reduce the launch angle in the direction of maximum sensitivity of vertical directivity with respect to the vertical polarization, reducing a possible decrease in sensitivity in the horizontal direction. The present embodiment further enables a reduction in the size of the ground plate 1 and thus of the antenna. The present embodiment further makes it possible to provide a corner reflector antenna with a ground plate having a wideband characteristic corresponding to a VSWR characteristic of at most 2.5 as shown in FIG. 4.

The characteristic impedance set to a value different from 200Ω can be converted by cascading one or more lines having a length equal to about 0.25 wavelength and a prescribed characteristic impedance.

SECOND EMBODIMENT

Now, a second embodiment of the present invention will be described.

Figure 5:
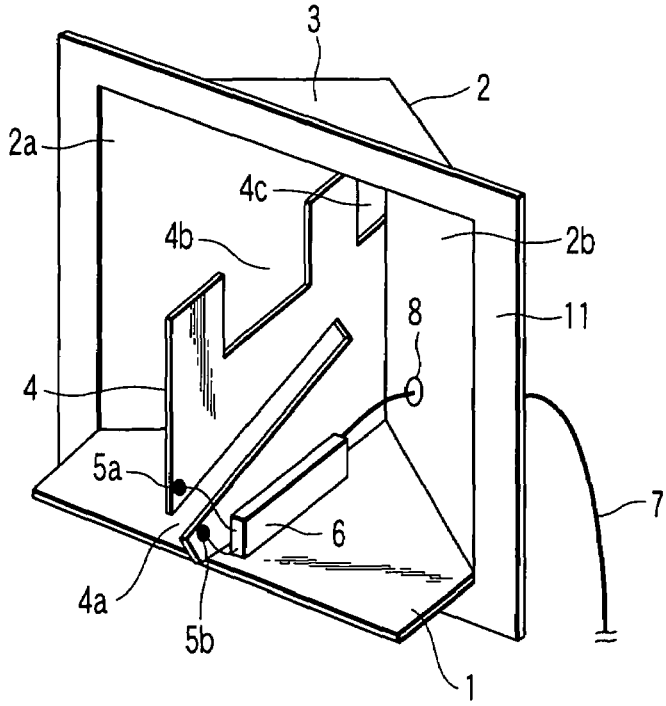
FIG. 5 is a perspective view showing a corner reflector antenna with a ground plate according to a second embodiment of the present invention.

As shown in FIG. 5, a corner reflector antenna with a ground plate according to the present embodiment is the same as that in FIG. 2 except that a flange 11 with a prescribed width is provided outside and around the periphery of a front end of the corner reflector 2 and that the radiating cutout 4*a*, formed in the radiator 4, is inclined. The remaining part of configuration of the present embodiment is the same as that of the first embodiment. Accordingly, the same components are denoted by the same reference numerals and their detailed description is omitted.

The flange 11 comprises a planar metal plate with a prescribed width which is disposed outside and around the periphery of the front end of the corner reflector 2 so as to extend outward. That is, the flange 11 is disposed perpendicularly to the ground plate 1. The width of the flange 11 is set equal to, for example, about 0.07 wavelength. In the corner reflector antenna with the ground plate in FIG. 5, the corner reflector 2 is composed of the metal plates 2*a* and 2*b* combined together so as to form an apical angle of about 120° and having long sides each set equal to about 0.45 wavelength and short sides each set to about 0.35 wavelength.

In the radiating cutout 4*a*, the width d2 is set equal to about 0.05 wavelength, and the length L1 is set equal to about 0.35 wavelength. The distance d1 between the radiating cutout 4*a* and the ground plate 1 in the vicinity of the feeding points 5*a* and 5*b* is set to about 0.06 wavelength. The radiating cutout 4*a* is thus inclined so as to separate from the ground plate 1 as it approaches the corner reflector 2. The inclination is set to, for example, about 10°.

Figure 6A:
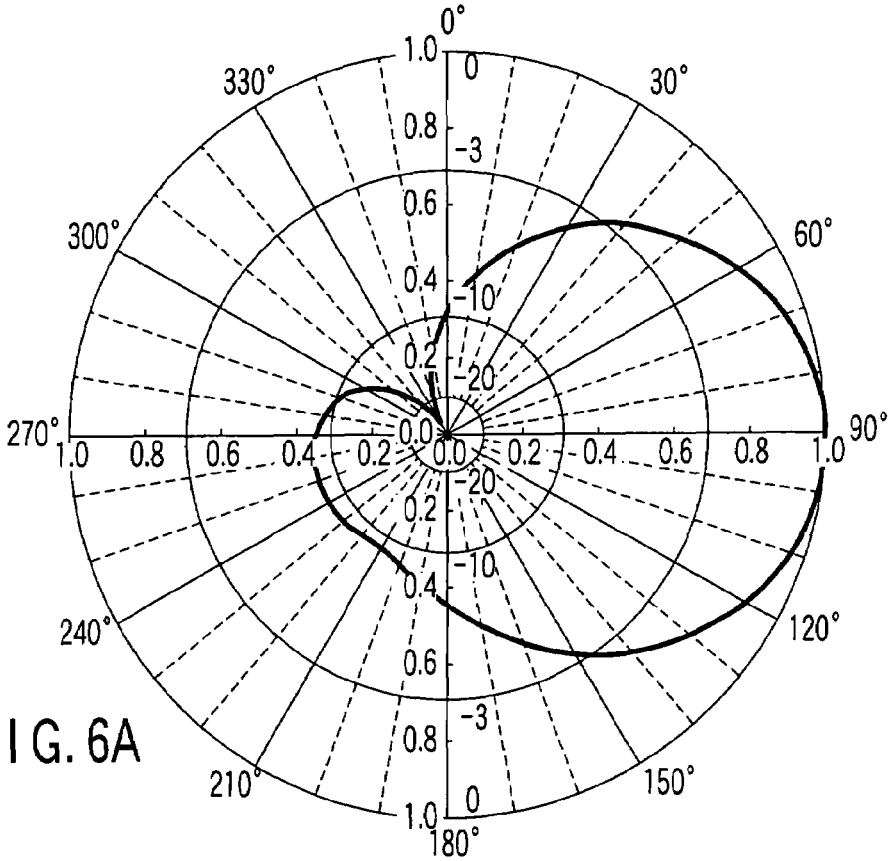
FIG. 6A shows vertical directivity with respect to a vertical polarization at the central frequency of the operating frequency of the corner reflector antenna with the ground plate in FIG. 5.
Figure 6B:
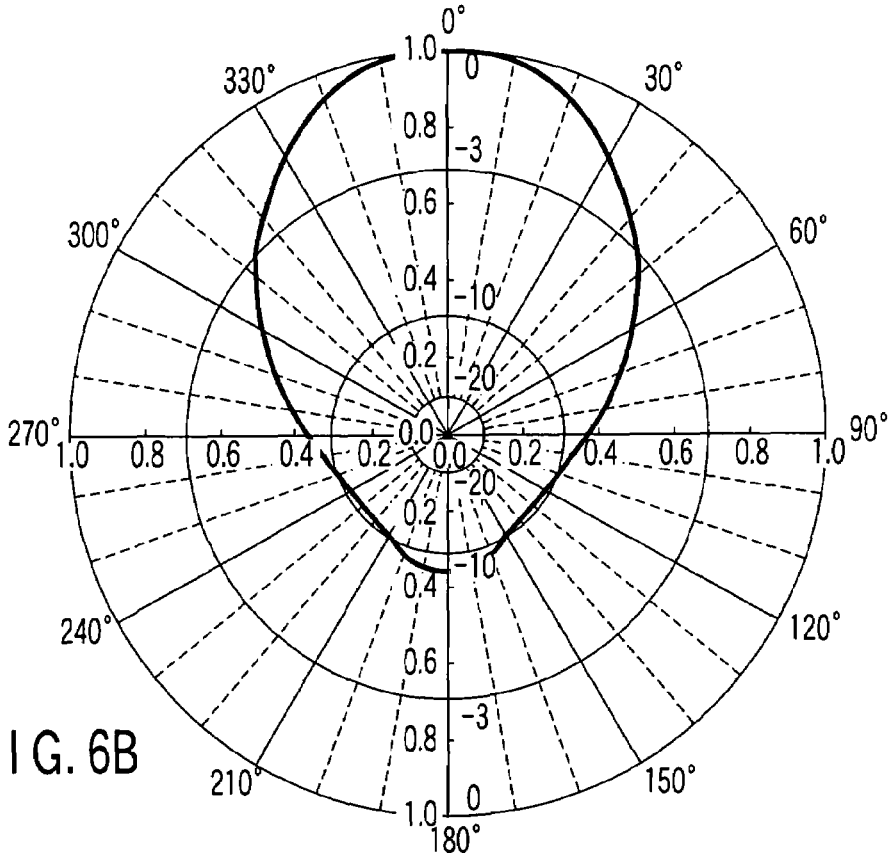
FIG. 6B shows horizontal directivity with respect to the vertical polarization at the central frequency of the operating frequency of the corner reflector antenna with the ground plate in FIG. 5.

As shown in FIGS. 6A and 6B, present embodiment can reduce, at the central frequency of the operating frequency, the launch angle in the direction of maximum sensitivity of vertical directivity with respect to the vertical polarization to about 0°, reducing a possible decrease in sensitivity in the horizontal direction to about 0 dB. The beam width of horizontal directivity can be adjusted on the basis of the size and apical angle of the corner reflector 2.

Figure 7:
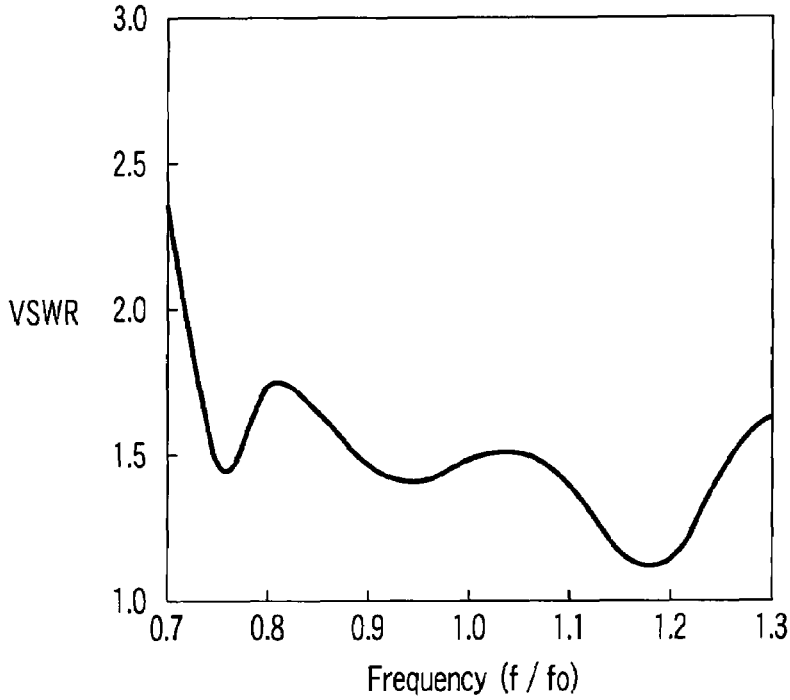
FIG. 7 shows a VSWR characteristic observed after an impedance conversion in the corner reflector antenna with the ground plate in FIG. 5.

FIG. 7 shows a VSWR characteristic obtained by using a U-balun as the impedance converter 6 connected to the feeding points 5*a* and 5*b* and converting the impedance from 200Ω to 50Ω. In FIG. 7, the axis of abscissa shows a frequency (f/fo). The axis of ordinate shows VSWR.

The present embodiment can offer a wideband characteristic of at most 2.5 similarly to the first embodiment.

The antenna with the flange 11 provided around its periphery can be more easily installed, for example, on a under side surface of a train vehicle. Moreover, if the antenna is installed in a vehicle or the like and an insulating cover or the like is required, it can also be easily mounted.

In the present and first embodiments, the ground plate 1 is formed to be almost pentagonal. However, the present invention is not limited to the pentagon. Any other shape may be used. For example, substantially equivalent characteristics are obtained with both corners of front end of the ground plate 1 removed.

THIRD EMBODIMENT

Now, a third embodiment of the present invention will be described.

The second embodiment can reduce the launch angle in the direction of maximum sensitivity of vertical directivity with respect to the vertical polarization, reducing a possible decrease in sensitivity in the horizontal direction. The embodiment further enables a reduction in the size of the ground plate and thus of the antenna. However, the vertical directivity with respect to the vertical polarization in a region of frequencies lower than the central frequency of the operating frequency tends to incline downward.

Figure 8:
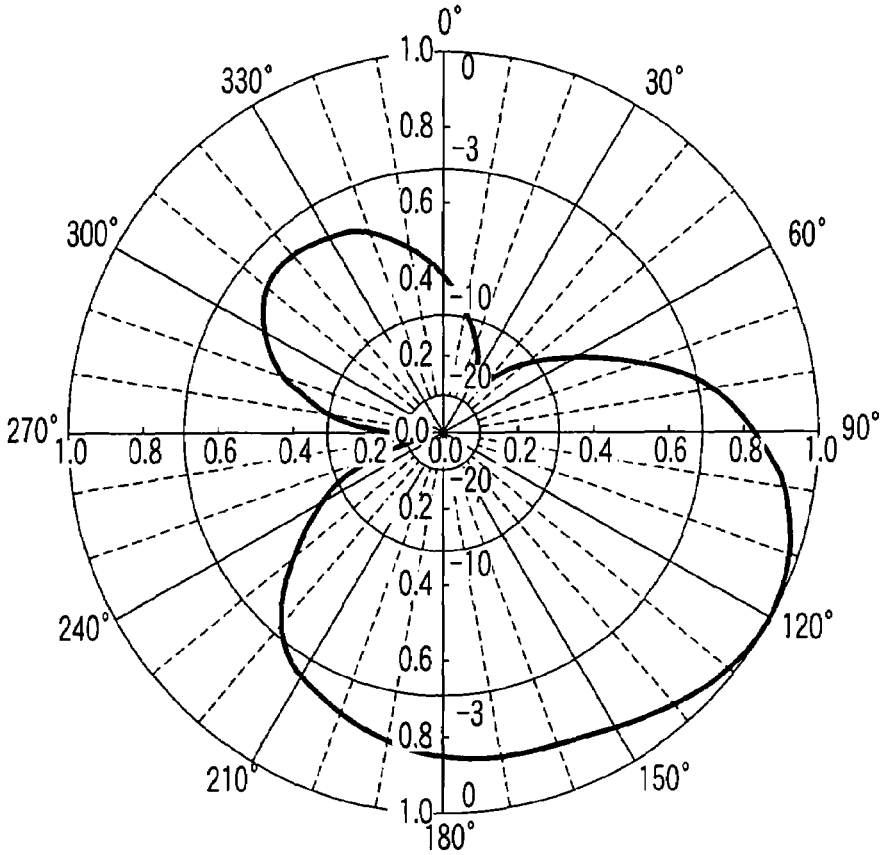
FIG. 8 shows vertical directivity with respect to the vertical polarization in a region of frequencies lower than the central frequency of the operating frequency of the corner reflector antenna with the ground plate in FIG. 5.

For example, at a frequency of about 0.75×fo, the direction of maximum sensitivity of vertical directivity with respect to the vertical polarization in the corner reflector antenna with the ground plate in FIG. 5 coincides with a downward angle of at about 30° as shown in FIG. 8. Further, the sensitivity in the horizontal direction is about 0.83 times as high as that in the direction of maximum sensitivity (about −1.6 dB). In FIG. 8, the direction of 0 coincides with the zenithal direction.

Figure 9:
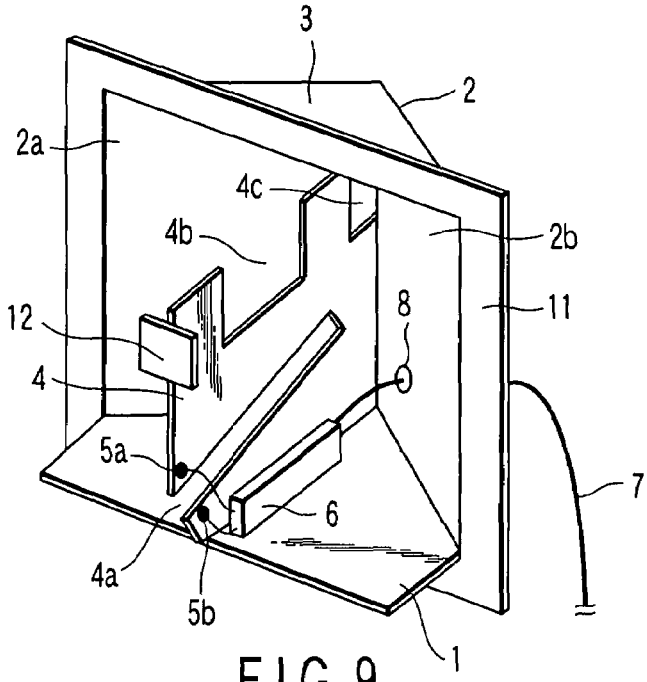
FIG. 9 is a perspective view showing a corner reflector antenna with a ground plate according to a third embodiment of the present invention.

As shown in FIG. 9, the corner reflector antenna with the ground plate according to the present embodiment is the same as that in FIG. 5 except that an adjusting plate 12 is provided on the upper part of front end of the radiator 4. The remaining part of configuration of the present embodiment is the same as that of the second embodiment. Accordingly, the same components are denoted by the same reference numerals and their detailed description is omitted.

The adjusting plate 12 is, for example, a rectangular metal conductor with a size equal to 0.1×0.1 wavelength and reduces a possible decrease in sensitivity in the horizontal direction at relatively low frequencies.

Figure 10:
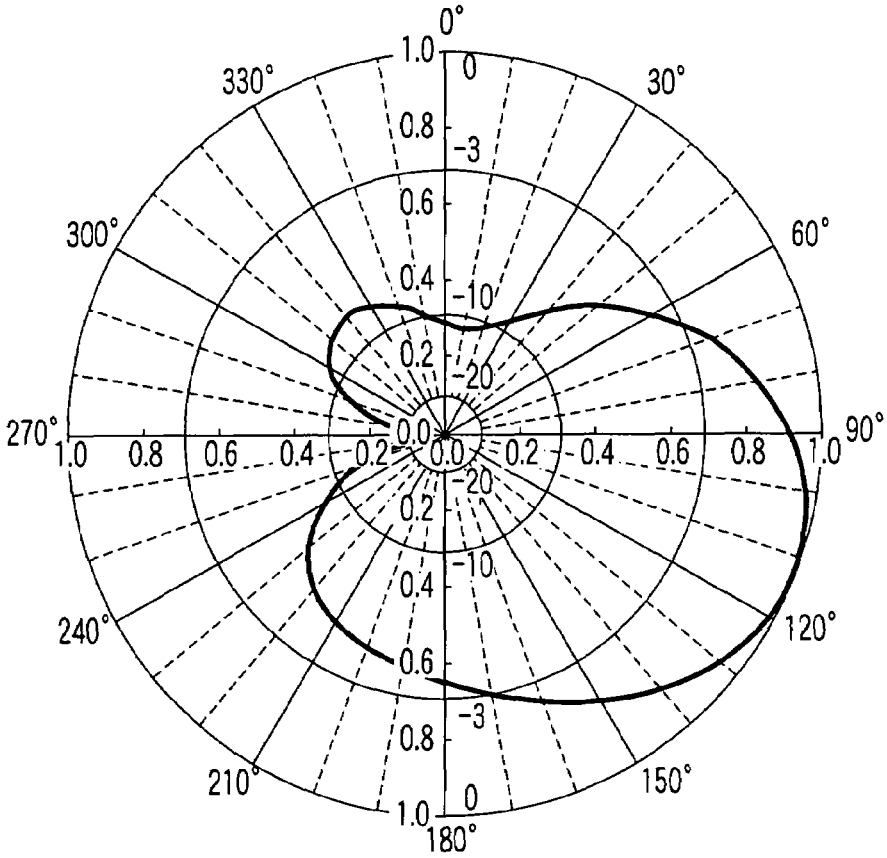
FIG. 10 shows vertical directivity with respect to the vertical polarization in a region of frequencies lower than the central frequency of the operating frequency of the corner reflector antenna with the ground plate in FIG. 9.
Figure 11:
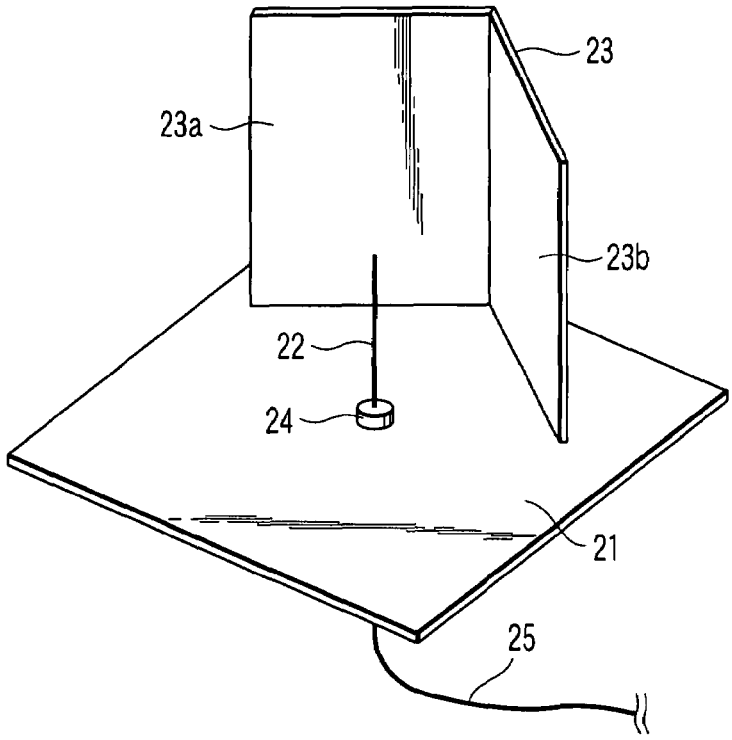
FIG. 11 (PRIOR ART)
FIG. 11 is a perspective view showing a conventional corner reflector antenna with a ground plate.
Figure 13:
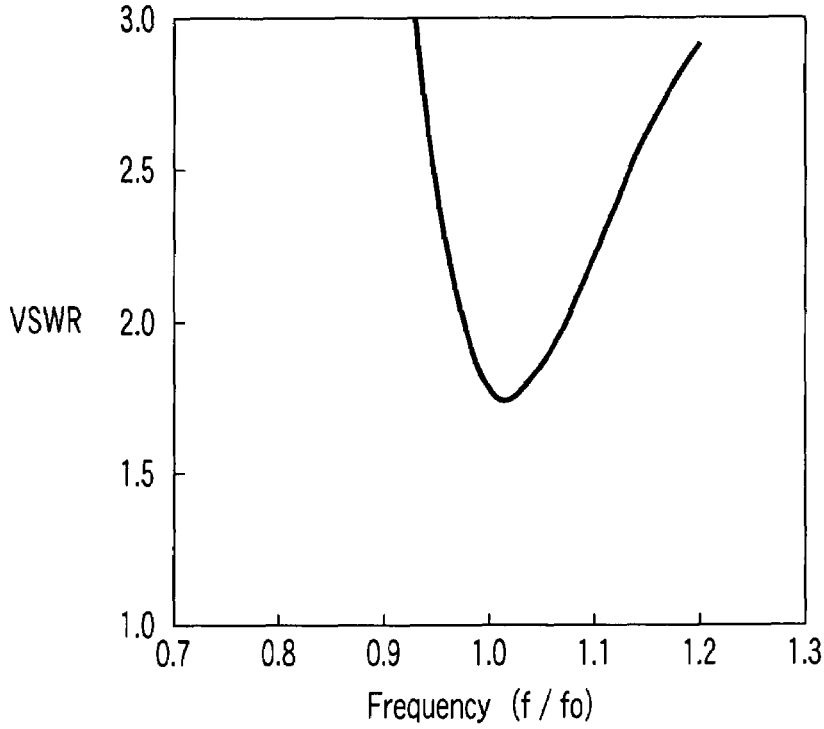
FIG. 13 (PRIOR ART)
FIG. 13 shows a VSWR characteristic observed after an impedance conversion in the corner reflector antenna with the ground plate in FIG. 11.
Figure 12A:
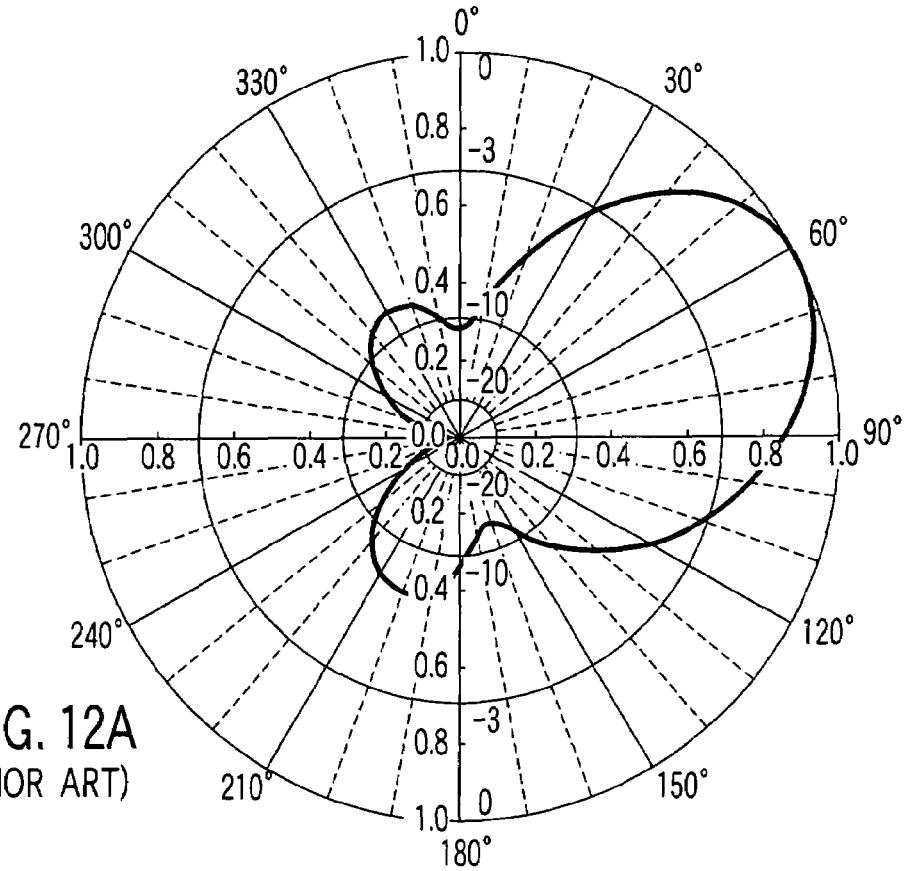
FIG. 12A (PRIOR ART)
FIG. 12A shows vertical directivity with respect to a vertical polarization at the central frequency of the operating frequency of the corner reflector antenna with the ground plate in FIG. 11.
Figure 12B:
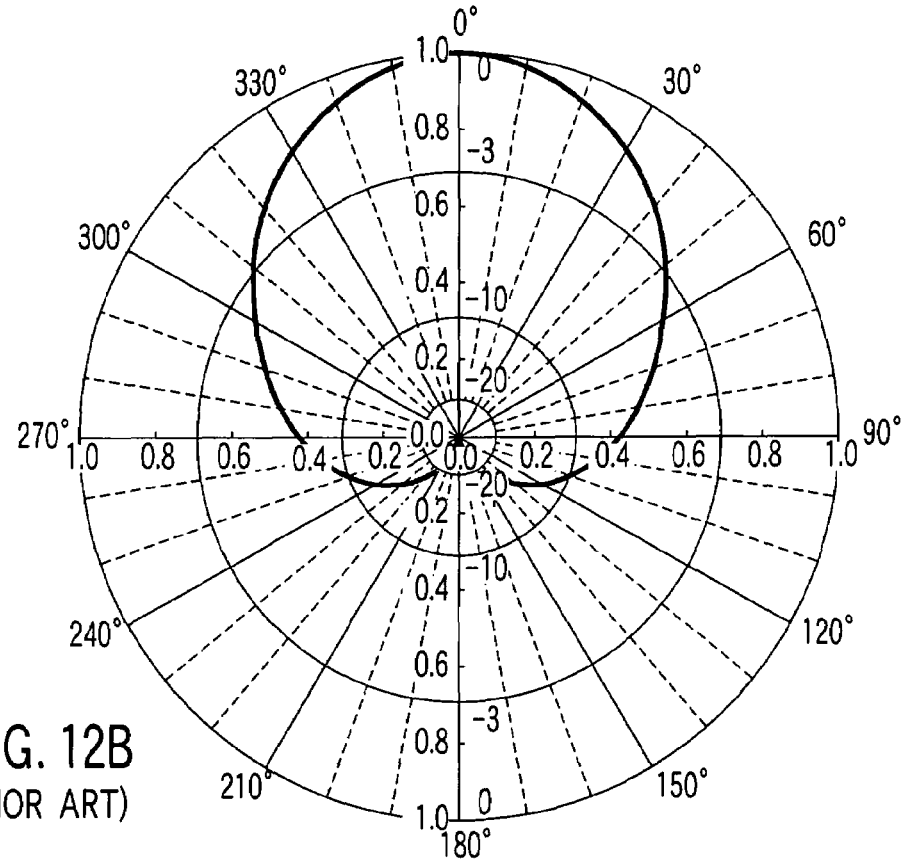
FIG. 12B (PRIOR ART)
FIG. 12B shows horizontal directivity with respect to the vertical polarization at the central frequency of the operating frequency of the corner reflector antenna with the ground plate in FIG. 11.

At a frequency of about 0.75×fo, the direction of maximum sensitivity of vertical directivity with respect to the vertical polarization in the corner reflector antenna with the ground plate in FIG. 9 is coincides with a downward angle of at about 20° as shown in FIG. 10. Further, the sensitivity in the horizontal direction is about 0.93 times as high as that in the direction of maximum sensitivity (about −0.6 dB). Consequently, the corner reflector antenna with the ground plate in FIG. 9 reduces a possible decrease in sensitivity in the horizontal direction compared to that in FIG. 5.

As shown in the present embodiment, with the adjusting plate 12 with a size equal to about 0.1×0.1 wavelength provided on the upper part of front end of the radiator 4, the directivity variation occurs mostly in the vertical directivity with respect to the vertical polarization at frequencies lower than the central frequency of the operating frequency. The directivity varies very insignificantly at high frequencies.

The adjusting plate 12 is not limited to the above size. The effect of reduction of a possible decrease in sensitivity in the horizontal direction depends on the size or position of the adjusting plate 12. Accordingly, the size of the adjusting plate 12 can be selected as required.

In the present embodiment, the adjusting plate 12 is provided in the corner reflector antenna with the ground plate in FIG. 5. However, similar effects are obtained by providing the adjusting plate 12 in the corner reflector antenna with the ground plate in FIG. 1.

As described above, an aspect of the present invention can reduce the launch angle in the direction of maximum sensitivity of vertical directivity with respect to the vertical polarization, reducing a possible decrease in sensitivity in the horizontal direction. The present embodiment further enables a reduction in the size of the ground plate and thus of the antenna.

Another aspect of the present invention combines the ground plate with the metal plate having the radiating cutout, adjusting cutout, and the like as a radiator so that the impedance can be set to a larger value of 100 to 300Ω by adjusting the distance between the radiating cutout and the ground plate. Thus, a wideband characteristic can be obtained by reducing a possible variation in impedance relative to a possible variation in frequency and using the impedance converter to convert the impedance into a lower one of for example, 50Ω.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A corner reflector antenna comprising:

a ground plate having a main surface;

a reflector including a rectangular first metal plate and a rectangular second metal plate which are perpendicularly provided on the main surface of the ground plate, the first and second metal plates being combined together to form a prescribed angle;

a radiator including a rectangular third metal plate perpendicularly provided on the main surface of the ground plate, at a position where the angle is divided in half, the third metal plate including a first edge which is opposite the main surface, the first edge having a plurality of first cutouts, and a second edge which is opposite the reflector, the second edge having a second cutout extending toward the reflector; and a first feeding point and a second feeding point provided on respective sides of the second cutout on the third metal plate in the vicinity of the second edge.

2. The corner reflector antenna according to claim 1, wherein the first and second feeding points are supplied with electricity via an impedance converter.

3. The corner reflector antenna according to claim 1, further comprising: a triangular shield plate provided on the reflector parallel to the ground plate.

4. The corner reflector antenna according to claim 1, wherein the second cutout is inclined so that the distance between the second cutout and the main surface of the ground plate increases as the second cutout separates from an end of the second cutout lying opposite the reflector.

5. The corner reflector antenna according to claim 1, further comprising: a flange provided around a periphery of the reflector and orthogonally to the ground plate.

6. The corner reflector antenna according to claim 1, further comprising: an adjusting plate provided on an end of the radiator which is opposite the reflector and above the second cutout.

7. A corner reflector antenna comprising:

a ground plate having a main surface;

a corner reflector provided on the main surface of the ground plate and having a reflecting surface;

a radiator including a rectangular metal plate perpendicularly provided on the main surface of the ground plate, in front of the reflecting surface, the metal plate including a first edge which is opposite the main surface, the first edge having a plurality of first cutouts, and a second edge which is opposite the corner reflector, the second edge having a second cutout extending toward the corner reflector;

a first feeding point and a second feeding point provided on respective sides of the second cutout on the metal plate in the vicinity of the second edge; and an impedance converter connected between the first and second feeding points and a feeding line.

8. The corner reflector antenna according to claim 7, further comprising: a triangular shield plate provided on the corner reflector parallel to the ground plate.

9. The corner reflector antenna according to claim 7, wherein the second cutout is inclined so that the distance between the second cutout and the main surface of the ground plate increases as the second cutout separates from an end of the second cutout lying opposite the corner reflector.

10. The corner reflector antenna according to claim 7, further comprising: a flange provided around a periphery of the corner reflector and orthogonally to the ground plate.

11. The corner reflector antenna according to claim 7, further comprising: an adjusting plate provided on an end of the radiator which is opposite the corner reflector and above the second cutout.

12. The corner reflector antenna according to claim 7, wherein the impedance converter includes a U-balun.

* * * * *